US006206347B1

(12) United States Patent
Kelley

(10) Patent No.: US 6,206,347 B1
(45) Date of Patent: Mar. 27, 2001

(54) JUVENILE SECURITY FENCE

(76) Inventor: Rickey D. Kelley, 2101 SE. 8th St., Oklahoma City, OK (US) 73129

( * ) Notice: Subject to any disclaimer, the term of this patent is extended or adjusted under 35 U.S.C. 154(b) by 0 days.

(21) Appl. No.: 09/400,263

(22) Filed: Sep. 21, 1999

(51) Int. Cl.[7] ..... B21F 27/00; E04H 17/02; E04H 17/00

(52) U.S. Cl. ..... 256/47; 286/1; 286/11; 286/12; 286/48; 286/54

(58) Field of Search ..... 256/47, 11, 1, 256/12, 21, 22, 32, 48, 49, 54

(56) References Cited

U.S. PATENT DOCUMENTS

| | | | | |
|---|---|---|---|---|
| D. 215,726 | * | 10/1969 | Skibowski | D28/1 |
| 697,259 | * | 4/1902 | Lavely | 256/21 |
| 2,734,727 | * | 2/1956 | Hensley | 256/48 |
| 2,823,034 | | 2/1958 | Bingham | 273/95 |
| 3,022,044 | * | 2/1962 | Gugino | 256/47 |
| 3,222,067 | | 12/1965 | Litwhiler | 273/26 |
| 4,673,166 | * | 6/1987 | MacDougall | 256/11 |
| 4,883,257 | * | 11/1989 | Bracken | 256/54 |
| 5,556,080 | * | 9/1996 | Vise | 256/24 |
| 6,010,116 | * | 1/2000 | Knott, Sr. | 256/47 |

FOREIGN PATENT DOCUMENTS

| | | | | |
|---|---|---|---|---|
| 2241721 | * | 9/1991 | (GB) . | |
| 5-202649 | * | 8/1993 | (JP) | 256/1 |

* cited by examiner

*Primary Examiner*—Lynne H. Browne
*Assistant Examiner*—Ernesto Garcia
(74) *Attorney, Agent, or Firm*—Robert K. Rhea

(57) ABSTRACT

A juvenile security fence system enclosing an area is formed by a plurality of line, terminal end and corner posts with each post being characterized by a vertical base section having its depending end portion embedded in the earth and having a portion of its upper end angularly inclined inwardly and upwardly terminating in a vertical upright relatively short section. Wire fencing of selected mesh is attached to the surface of the post facing the area to be enclosed by a plurality of post surrounding bands securing an adjacent portion of the wire mesh to the respective post and spaced longitudinally of the post. Terminal end and corner posts secure respective end portions of the wire fabric by similar post surrounding tension bands secured by bolts precluded from contact by an inmate by steel plates coextensive with the respective post and bridging the space between the post and the terminal end portion of the respective fence fabric.

6 Claims, 2 Drawing Sheets

JUVENILE SECURITY FENCE

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to fencing and more particularly to substantially tamper proof juvenile inmate security fencing.

1. Field of the Invention

Security fencing usually comprises steel posts secured in the surface of the earth in equally spaced aligned relation. Both the post and the wire mesh are usually galvanized steel or formed with a protective coating to minimize oxidation of the wire and fastening members securing the wire mesh to the posts. A further problem with security fencing concerns inmates gaining access to the fastener securing the wire mesh to the posts as at corner intersections of the fence. Thus, allowing inmates to work the wire mesh loose or at least separate a portion of it from the posts and escape through such openings. This invention, it is believed, overcomes this problem by forming a substantially tamper proof wire fence structure.

2. Description of the Prior Art

The most pertinent patent is believed to be U.S. Pat. No. 4,883,257, issued Nov. 29, 1989 to Bracken for Security Fencing. The subject matter of his patent is particularly directed toward the posts which hold the fence fabric and utilizes a two-piece post, with a base post inserted into the surface of the earth. The fencing is then attached and an outer or second portion of the post is fitted over the base portion to prevent inmates from gaining access to terminal ends of fencing and loosening it from the posts. Nine examples are given of this fence and post arrangement.

Other patents related to security fencing are generally directed toward recreation play areas or sporting events, such as batting cages, and also to animal or bird enclosures.

U.S. Pat. No. 2,823,034 issued Feb. 11, 1988 to H. Bingham, Jr. discloses a Recreational Enclosure and D. Whitler, et al. U.S. Pat. No. 322,067, issued Dec. 7, 1965 for Baseball Batting Cage are examples of the further state of-the-art. Each of these patents disclose a fence wall and top enclosure for the purposes identified by the title of the respective patent.

BRIEF SUMMARY OF THE INVENTION

The fence of this invention is formed by a plurality of posts extending in selected spaced relation along the perimeter of an area to be enclosed. Each post comprises an upright base section having a portion of its length embedded in the surface of the earth and surrounded adjacent the surface of the earth by a section of concrete of predetermined depth and mass. The upper portion of the upright section of the respective post is inclined inwardly and upwardly, a length substantially equal to one-third of the vertical height of its base section, and terminates in an upright section of relatively short length. The short upright sections of adjacent posts being rigidly interconnected by a pair of vertically spaced horizontal top rails to preclude lateral movement of the inclined section of the respective post longitudinally of the fence line. Similarly, the upper limit of the base section is interconnected by a brace rail and at least two other brace rails extend horizontally between and are secured to the respective post base section in equally spaced vertical relation.

Wire fencing which may be chain link fencing of selected mesh is secured to the inward side of the several posts and fastened thereto by a plurality of tension bands surrounding respective posts and an adjacent portion of the wire mesh. A multi-strand wire extends through the depending limit of the mesh adjacent the surface of the earth and is secured to the respective post to prevent uplifting of the wire mesh with respect to the surface of the earth. Terminal ends of the fencing adjacent a building and at the respective corner posts are secured to the respective post by bolt tension bands. The tension band bolt is blocked from access thereto by a rigid metal plate coextensive with the length of the respective post and laterally spanning the area between the post and the terminal end portion of the fence fabric.

The principal object of this invention is to provide a juvenile security fence of sufficient height and configuration to prevent individuals reaching the top thereof to climb over the fence and having all fence fabric terminal ends shielded from manual access thereto.

DETAILED DESCRIPTION OF THE INVENTION

Figure 1:
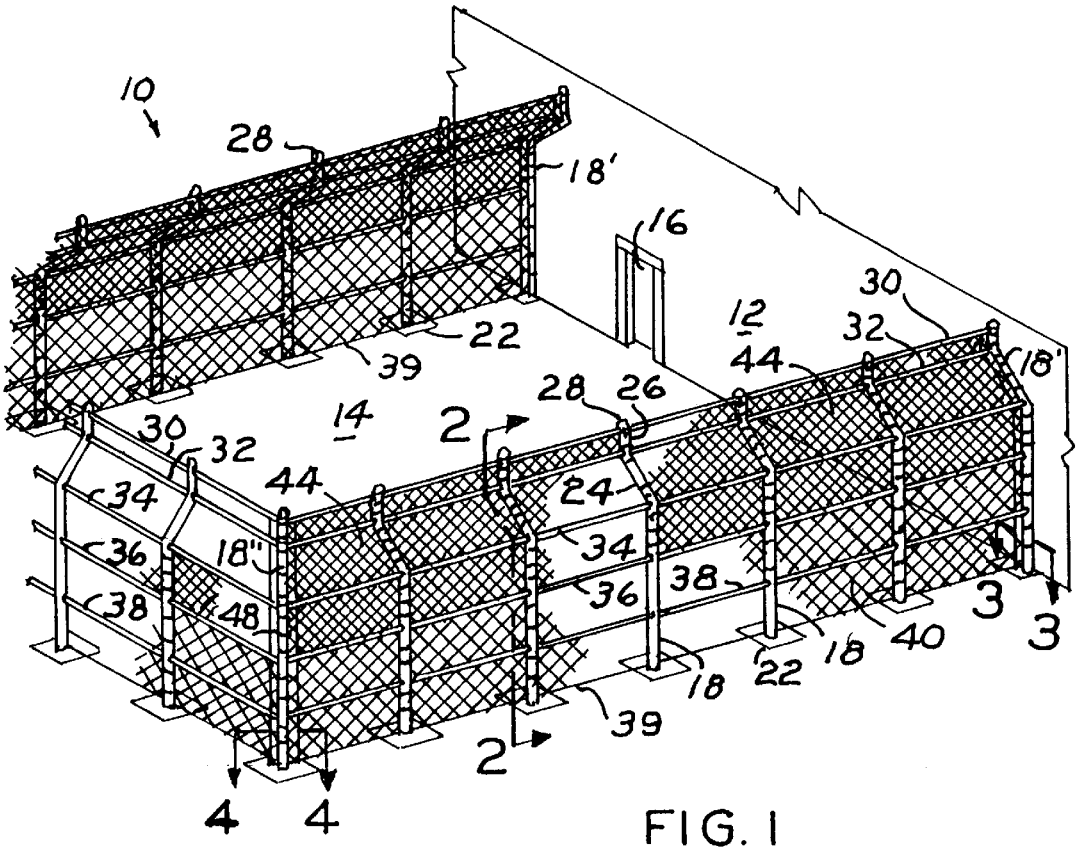
FIG. 1 is a fragmentary isometric view of the security fence enclosing an area adjacent a building structure.

Like characters of reference designate like parts in those figures of the drawings in which they occur.

In the drawings:

The reference numeral 10 indicates a section of fence secured to and projecting laterally of a structure such as a building 12 to enclose an area 14 of selected dimensions. Ingress and egress to the area 14 is obtained through an opening or door 16 in the building 12. The fence 10 comprises a plurality of upright posts 18 extending in spaced apart relation along three sides of the perimeter of the area 14 including end posts 18' and corner posts 18", only one of the latter being shown. A plurality of horizontal rails or braces extend between and are secured to the respective post. A continuous length of fence fabric is attached to the inward surfaces of the respective post, as will now be described.

Since the fence posts 18 are substantially identical, only one will be described in detail in the interest of brevity. The post 18, preferably 10.16 cm (4 in.) diameter is provided with a vertically upright base section 19 of a selected length with approximately one fourth of this length extending below the surface of the earth 21 and surrounded by a section of concrete 22 of selected mass adjacent the surface of the earth.

A length 24 of the post, approximately equal with one third the length of the base section 19 extends angularly inward and upward on an obtuse angle A, of at least 120°, with respect to the vertical axis of the post base section 19. A relatively short section 26, approximately one-fourth the length of the inclined section 24, extends vertically upright from the upper limit of the inclined section 24 and is topped by a dome cap 28.

A pair of vertically spaced top rails 30 and 32 extend horizontally between and are secured to the upper and lower end portion of the post short section 26. Other intermediate rails 34, 36 and 38 extend horizontally between and are respectively secured to the post base section 19 at its junction with the inclined section 24 and in vertical equally spaced relation therebelow.

A continuous length of relatively heavy gauge woven wire fabric 40 of selected mesh is attached to the inward surface of the depending two-thirds portion of the post base section 19 from the rail 36 downwardly, by a plurality of selectively spaced tension bands 42, secured by bolts 41, to surround the respective post and an adjacent portion of the wire fabric with the bolt fastener disposed on the outward side of line posts 18. The depending limit of the wire mesh 40 has a multistrand wire or cable 39 extending tautly through the wire mesh and secured to the respective post base section adjacent the respective concrete section 22 to prevent any lifting of the wire mesh with respect to the surface of the earth. Similarly a lighter gauge and preferably smaller mesh of continuous length of wire fabric 44 is similarly secured to the inward surfaces of the remaining upper portion of the post base section 19 and the inclined section 24 and the vertical section 26 by other tension bands 42.

Figure 3:
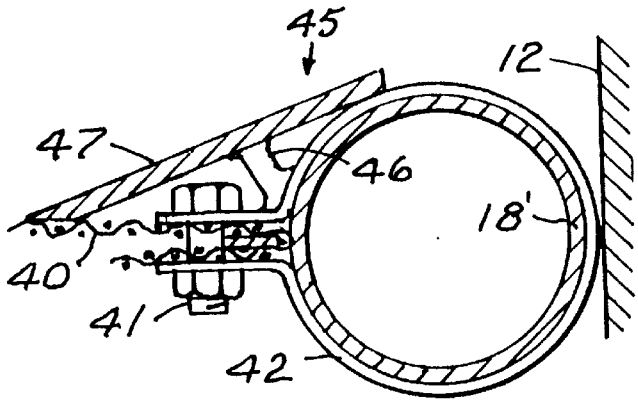
Figure 2:
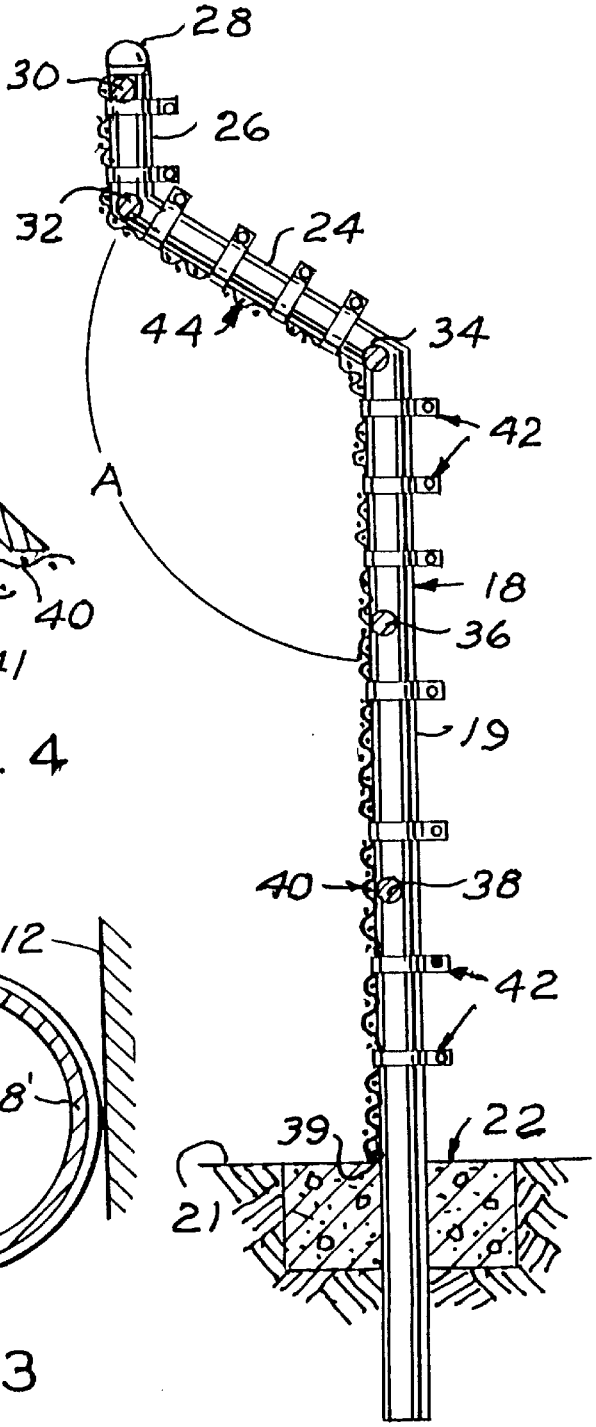
FIG. 2 is a vertical cross sectional view taken substantially along the line of 2—2 of FIG. 1.

As illustrated by FIG. 3, the strap iron tension band 42 terminal end portions are line drilled to receive the bolt 41 gripping the adjacent opposed end portion of the strap iron to secure the terminal ends of the wire fabric 40 and 44 in a manner conventional with a woven wire fencing. Access to the clamp end portions 44 and bolt 41 by inmates is denied by plate means 45 including lateral prongs 46 rigidly connected with the respective band 42 and projecting inwardly of the fence fabric 40 or 41. A metallic plate 47 of selected thickness and a width sufficient to span the area between an adjacent peripheral portion of the post and tension band and the terminal end portion of the fence fabric 40 or 41, and co-extensive with the entire length of the respective end posts 18' and is attached to the prongs 46 as by welding.

Figure 4:
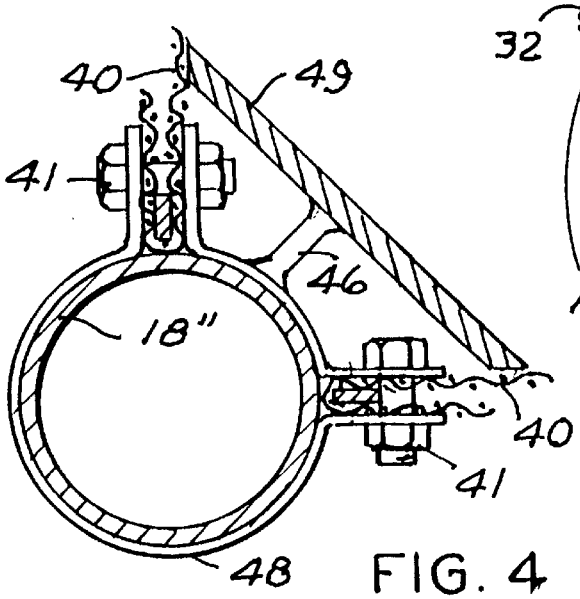
FIGS. 3 and 4 are horizontal cross sectional views taken substantially along lines 3—3 and 4—4, respectively of FIG. 1.

Referring more particularly to FIG. 4, corner bolt tension bands 48, similar to the bands 42, include a second bolt tightening strap iron end portions spaced 90° from the first named band clamp 42 for anchoring the terminal end of an adjacent portion of the fence fabric 40 or 44. Similarly, other prongs 46 project outward from the respective tension band 48 and a similar plate 49 of selected gauge metallic material co-extensive with the respective corner post and having a width sufficient to span the area between adjacent end portions of the fence fabric at the corner position and is similarly rigidly secured to the prongs 46, thus precluding manual access to the bolt clamped fence fabric end portions 43 and 43' by inmates.

Obviously the invention is susceptible to changes or alterations without defeating its practicability. Therefore, I do not wish to be confined to the preferred embodiment(s) shown in the drawing(s) and described herein.

I claim:

1. Juvenile security fence, comprising:

a plurality of posts including line, terminal end posts and corner posts surrounding an area to be secured, each said post comprising an elongated vertical base section having a depending end portion adapted to be fixed in the surface of the earth in spaced aligned relation with adjacent posts, and each said post having a second section, substantially equal with one-third the length of the base section above the surface of the earth, upwardly inclined toward the area to be enclosed and terminating in a relatively short vertical section substantially equal in length with one-third the length of the inclined second section;

a plurality of rails extending horizontally between adjacent posts in vertical spaced relation;

continuous lengths of fence fabric of selected mesh extending between selected terminal end or corner posts;

tension band means, surrounding each post in vertically spaced relation, for securing the fence fabric to the posts; and, plate means, coextensive with and rigidly secured to the tension band means, for precluding access to end portions of said fence fabric adjacent terminal end posts or corner posts.

2. The fence according to claim 1 in which the tension band means comprises:

a strap iron having transversely apertured end portions extending laterally of the respective post in cooperative opposition and opposite of the enclosed area; and, fastener means biasing said strap iron end portions toward each other.

3. The fence according to claim 2 in which the fastener means comprises; a bolt and a nut.

4. Juvenile security fence, comprising:

a plurality of posts including line, terminal end posts and corner posts surrounding an area to be secured, each said post comprising an elongated vertical base section having a depending end portion adapted to be fixed in the surface of the earth in spaced aligned relation with adjacent posts, and each said post having a second section, substantially equal with one-third the length of the base section above the surface of the earth, upwardly inclined toward the area to be enclosed and terminating in a relatively short vertical section substantially equal in length with one-third the length of the inclined second section;

continuous lengths of fence fabric of selected mesh extending between selected terminal end or corner posts;

tension band means, surrounding each post in vertically spaced relation, for securing the fence fabric to the posts; and, plate means, coextensive with and rigidly secured to the tension band means, for precluding access to end portions of said fence fabric adjacent terminal end post or corner posts.

5. The fence according to claim 4 in which the tension band means comprises:

a strap iron having transversely apertured end portions extending laterally of the respective post in cooperative opposition opposite the enclosed area; and, fastener means biasing said strap iron end portions toward each other.

6. The fence according to claim 5 in which the fastener means comprises;

a bolt and a nut.

* * * * *